US007475691B2

(12) United States Patent
Dürnberger

(10) Patent No.: US 7,475,691 B2
(45) Date of Patent: Jan. 13, 2009

(54) MASCARA BRUSH

(75) Inventor: Hans Dürnberger, Bechhofen (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 127 days.

(21) Appl. No.: 10/941,914

(22) Filed: Sep. 16, 2004

(65) Prior Publication Data

US 2005/0061350 A1 Mar. 24, 2005

(30) Foreign Application Priority Data

Sep. 23, 2003 (DE) ..... 103 43 850

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/313, 120, 320; 15/206; 401/122, 129, 401/126, 127
See application file for complete search history.

(56) References Cited

U.S. PATENT DOCUMENTS 4,586,520 A * 5/1986 Brittain ..... 132/218
5,918,994 A 7/1999 Gueret
6,279,583 B1 * 8/2001 Neuner ..... 132/218
6,343,887 B1 2/2002 Dumler et al.

FOREIGN PATENT DOCUMENTS

| | | | |
|---|---|---|---|
| DE | 3735963 | C2 | 10/1987 |
| DE | 69714138 | T2 | 5/1997 |
| DE | 19848471 | A1 | 10/1998 |
| EP | 1050236 | A1 | 5/2000 |
| WO | WO 03/070051 | A1 | 8/2003 |

* cited by examiner

*Primary Examiner*—Robyn Doan
(74) *Attorney, Agent, or Firm*—Browdy and Neimark, P.L.L.C.

(57) ABSTRACT

In a mascara brush comprising a plurality of bristles which stand out radially and are held between two intertwisted wires, with the tips of the bristles varying in length in such a way that the bristle tips form envelope sections which, seen in the circumferential direction, lie radially further outwards and radially further inwards, it is provided that, seen in the circumferential direction, the envelope sections formed by longer bristles are shorter than the envelope sections formed by shorter bristles; that the envelope sections are convex; and that the length of the shorter bristles increases progressively in the circumferential direction and corresponding to the radius of curvature of the associated envelope sections.

6 Claims, 1 Drawing Sheet

MASCARA BRUSH

BACKGROUND OF THE INVENTION

1. Field of the Invention

The invention relates to a mascara brush comprising a plurality of bristles which stand out radially and are held between two intertwisted wires, the tips of the bristles having varying lengths in such a way that envelope sections formed by the bristle tips are put into practice which, seen in the circumferential direction, lie radially further outwards and radially further inwards.

2. Background Art

EP 1 050 236 teaches a brush of the generic type, comprising sections of longer bristles that are wider in the circumferential direction and sections of shorter bristles that are distinctly shorter in the circumferential direction, both forming a convex envelope.

DE 37 35 963 C2 also describes a mascara brush, the trimming of which includes concavely cut depressions so that a kind of comb of short length in the circumferential direction is produced between two such adjacent cuts.

Mascara brushes of the generic type are required to offer excellent properties of transfer from the reservoir to lashes on the one hand and optimal application and separation of the lashes on the other, which is what the two above documents proceed from.

SUMMARY OF THE INVENTION

It is an object of the invention to obtain a solution, complying optimally with those requirements that are fundamentally known.

According to the invention, this object is attained by the envelope sections of longer bristles being shorter in the circumferential direction than the envelope sections formed by shorter bristles; by the envelopes being convex; and by the length of the shorter bristles growing progressively in the circumferential direction, corresponding to the radius of curvature of the associated envelope.

The bristles of varying length and the resulting, varying effective rigidity help attain uniform application on to the lashes on the one hand and a combing and separating effect on the other, which to this extent has been known per se.

The progressive increase in length, according to the invention, of the shorter bristles will optimize the procedure of application, with a user turning the brush upon application, which simultaneously works in favor of the so-called curl effect, bending the lashes attractively.

In keeping with the invention, provision is made for transition by steps between the envelope sections of longer and shorter bristles.

In particular provision is made for a plurality of preferably three envelope sections of longer and shorter bristles.

By advantage, the free end of the trimming of bristles may taper conically in the axial direction.

Details of the invention will become apparent from the ensuing description of an exemplary embodiment, taken in conjunction with the drawing.

DESCRIPTION OF A PREFERRED EMBODIMENT

Figure 2:
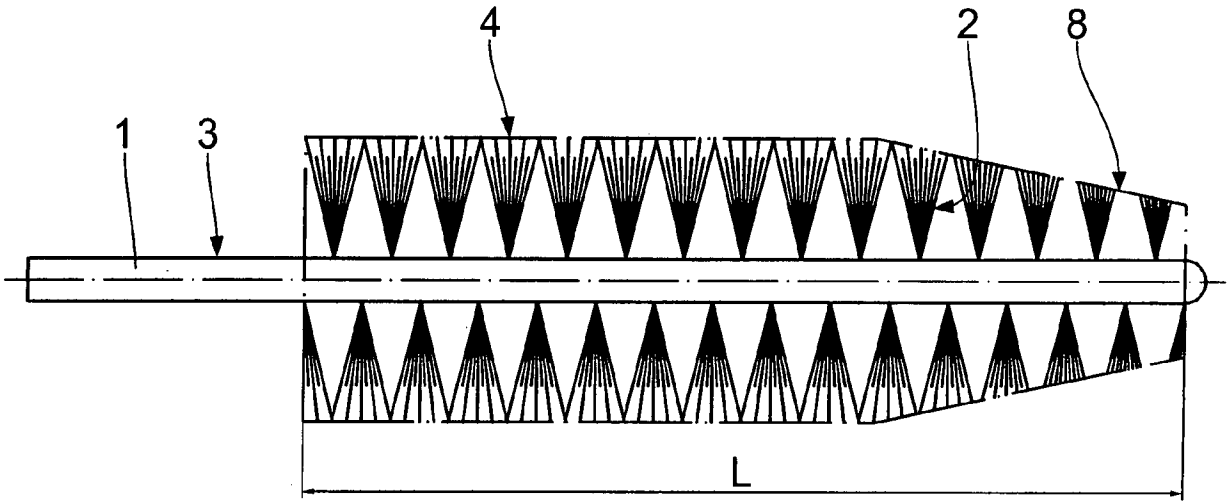
FIG. 2 is a view of the trimming as seen from A to C.

A mascara brush seen in the drawing comprises a core 1 of wire bent in the shape of a U, the two legs of which on either side of the bight of the U being intertwisted, fixing the bristles 2. In this way a trimming is formed over a length L, the free part 3 of the core 1 constituting a handle.

Figure 1:
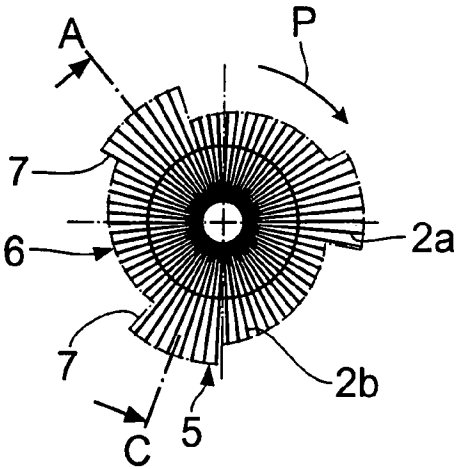
FIG. 1 is a sectional view of the area of trimming of a mascara brush according to the invention.

As seen in FIG. 1, the bristles 2 are trimmed for longer and shorter bristles 2*a* and 2*b* to be produced, the tips 4 of which constitute convex envelope sections 5 and 6. As shown in the cross-section of FIG. 1, all of the larger bristles 2*a* are of the same length.

The envelope sections 5 of longer bristles 2*a* are shorter in the circumferential direction, covering a smaller angular area than the envelope sections 6 of shorter bristles 2*b*. The envelope sections 5 pass by steps 7 into the envelope sections 6, each of which section 5 form a ridge between steps 7 that extend parallel to core 1, wherein the width of one step 7 of the ridge is greater than that of the other step 7 of the same ridge as shown in FIGS. 1 and 2. All of the steps 7 lie on a radius of curvature of the associated envelope section 6 wherein their widths respectively extend down radially toward the intertwisted wires from outer ends of the steps 7 engaged at the top surface of the ridge, as shown in FIG. 1 . In the exemplary embodiment, three envelope sections 5 are formed by longer bristles 2*a* and three envelope sections 6 are formed by shorter bristles 2*b*. One envelope section 5 and one envelope section 6 at a time make 120°, the width of the envelope sections 5 of longer bristles 2*a* being for example in the range of approximately 3 mm.

Proceeding from a first step 7, the length of the shorter bristles 2*b* or, respectively, the radius of curvature of the envelope sections 6 increases progressively towards the next step 7 in the direction of the arrow P.

Proceeding from an inner end of a first step 7 of a section 5 ridge of the longer bristles, the length of the shorter bristles 2*b* or, respectively, the radius of curvature of the envelope sections 6 increases progressively towards an inner end of next step 7 of another section 5 ridge of the longer bristle, in the direction of the arrow P.

What is claimed is:

1. A mascara brush, comprising a plurality of bristles (2) which stand out radially and are held between two intertwisted wires, tips of the bristles having varying lengths in such a way that envelope sections (5, 6) formed by the bristle tips are put into practice which, seen in a circumferential direction (P), lie radially further outwards and radially further inwards, wherein, the lengths along the circumferential direction (P) of the envelope sections (5) formed by longer bristles (2*a*) are shorter than those of the envelope sections (6) formed by shorter bristles (2*b*);

wherein the envelope sections (5, 6) are convex;

wherein the lengths of the longer bristles are all of the same length in a cross section of the brush; and wherein the envelope sections of the longer bristles each form a ridge extending parallel and continuously to said intertwisted wires which is limited by a first edge and a second edge each of which is parallel to said intertwisted wires;

wherein, the width of the first and second edges respectively extend down radially toward said intertwisted wires from outer ends of the first and second edges engaged at a top surface of the ridge to inner ends of the first and second edges engaged at the top surface of a corresponding envelope of shorter bristles, wherein the width of the first edge is greater than that of the second edge, and wherein the length of all the shorter bristles (2*b*) increase progressively outward along the circumferential direction (arrow P) between the inner end of the first edge of one ridge of the longer bristles and the inner end of the second edge of another ridge of the longer bristles and wherein the first edge and the second edge lie on a radius of curvature of the associated envelope sections (6).

2. A mascara brush according to claim 1, wherein a stepped transition area (7) along the length of the longer bristles is provided between the envelope sections (5 and 6) of longer and shorter bristles (2*a* and 2*b*).

3. A mascara brush according to claim 1, wherein provision is made for a plurality of preferably three envelope sections (5, 6) of longer and shorter bristles (2*a*, 2*b*).

4. A mascara brush according to claim 1, wherein the bristles (5, 6) are provided with a trimming; and wherein a free end of the trimming tapers conically in the axial direction.

5. A mascara brush according to claim 1, wherein the shorter bristles (2*b*) have a length of up to 4 mm.

6. A mascara brush according to claim 1, wherein the longer bristles (2*a*) have a length of between 5 mm and 30 mm.

* * * * *